US007166196B1

(12) United States Patent
Kramer et al.

(10) Patent No.: US 7,166,196 B1
(45) **Date of Patent: *Jan. 23, 2007**

(54) METHOD FOR MANUFACTURING RESIN-IMPREGNATED ENDLESS BELT STRUCTURES FOR PAPERMAKING MACHINES AND SIMILAR INDUSTRIAL APPLICATIONS AND BELT

(75) Inventors: Charles E. Kramer, Walpole, MA (US); Joseph G. O'Connor, Hopedale, MA (US); Maurice Paquin, Plainville, MA (US); John Skelton, Sharon, MA (US)

(73) Assignee: Albany International Corp., Albany, NY (US)

( * ) Notice: Subject to any disclaimer, the term of this patent is extended or adjusted under 35 U.S.C. 154(b) by 642 days.

This patent is subject to a terminal disclaimer.

(21) Appl. No.: 10/334,192

(22) Filed: Dec. 31, 2002

(51) Int. Cl.

| | |
|---|---|
| ***D21F 3/02*** | (2006.01) |
| ***B05D 5/00*** | (2006.01) |
| ***B05D 1/00*** | (2006.01) |
| ***B32B 27/04*** | (2006.01) |

(52) U.S. Cl. ..... 162/358.4; 162/901; 428/195.1; 428/196; 442/59; 427/195; 427/261; 427/288; 427/389.9

(58) Field of Classification Search ..... 162/203–207, 162/306, 348, 358.2, 358.4, 900–904, 109–117, 162/360–361; 156/459, 460; 428/192–194, 428/195.1, 198, 200, 206, 212, 213, 220, 428/143, 147, 304.4, 308.4, 314.2, 131; 442/59, 442/76, 148; 474/266–268; 427/9, 447, 427/448, 466, 470, 487, 492, 508–510, 513, 427/140, 176, 189, 195, 196, 201, 203, 209, 427/210, 244, 258, 261, 265, 285, 288, 331, 427/355, 370, 372.2, 384, 389.9, 394; 430/18, 430/322

See application file for complete search history.

(56) References Cited

U.S. PATENT DOCUMENTS

| | | | | |
|---|---|---|---|---|
| 3,042,568 | A | 7/1962 | Ludowici et al. | 156/137 |
| 3,149,003 | A | 9/1964 | Christie et al. | |
| 3,175,792 | A | 3/1965 | Smallian | 245/8 |
| 3,350,260 | A | 10/1967 | Johnson | 162/116 |
| 3,501,366 | A | 3/1970 | Bramley et al. | |
| 3,549,742 | A | 12/1970 | Benz | |
| 3,613,258 | A | 10/1971 | Jamieson | 34/95 |
| 3,673,023 | A | 6/1972 | Ross | 156/137 |
| 3,720,578 | A | 3/1973 | Heling et al. | |
| 3,994,662 | A | 11/1976 | Bramley | |

(Continued)

FOREIGN PATENT DOCUMENTS

| | | |
|---|---|---|
| DE | 196 51 557 | 6/1998 |

(Continued)

OTHER PUBLICATIONS

S. Ashley, Rapid Prototyping Systems, *Mechanical Engineering*, Apr. 1991, pp. 34-43.

*Primary Examiner*—Eric Hug
(74) *Attorney, Agent, or Firm*—Frommer Lawrence & Haug LLP; Ronald R. Santucci

(57) ABSTRACT

A method for manufacturing resin-impregnated endless belt structure and belt structure, designed for use on a long nip press on a papermaking machine and for other papermaking and paperprocessing applications, requires the application of a polymeric resin material onto a base substrate in a precise predetermined pattern in droplets having an average diameter of 10μ (10 microns) or more. The polymeric resin material is then set by means appropriate to its composition, and, optionally, may be abraded to provide the belt with a uniform thickness, and a smooth, macroscopically monoplanar surface.

54 Claims, 6 Drawing Sheets

U.S. PATENT DOCUMENTS

| | | | | |
|---|---|---|---|---|
| 4,109,543 | A | 8/1978 | Foti | 74/231 |
| 4,111,634 | A | 9/1978 | Limbach et al. | |
| 4,187,618 | A | 2/1980 | Diehl | 34/243 |
| 4,191,609 | A | 3/1980 | Trokhan | 162/113 |
| 4,239,065 | A | 12/1980 | Trokhan | 139/383 |
| 4,251,928 | A | 2/1981 | Rotar et al. | 34/116 |
| 4,300,982 | A | 11/1981 | Romanski | 162/358 |
| 4,312,009 | A | 1/1982 | Lange | 346/140 |
| 4,382,987 | A | 5/1983 | Smart | 428/212 |
| 4,383,495 | A | 5/1983 | Plichta et al. | 118/406 |
| 4,427,734 | A | 1/1984 | Johnson | 428/234 |
| 4,482,430 | A | 11/1984 | Majaniemi | 162/358 |
| 4,514,345 | A * | 4/1985 | Johnson et al. | 264/425 |
| 4,528,239 | A | 7/1985 | Trokhan | 428/247 |
| 4,529,480 | A | 7/1985 | Trokhan | 162/109 |
| 4,567,077 | A | 1/1986 | Gauthier | 428/114 |
| 4,571,798 | A | 2/1986 | Adams | |
| 4,637,859 | A | 1/1987 | Trokhan | 162/109 |
| 4,752,519 | A | 6/1988 | Boyer et al. | |
| 4,917,937 | A | 4/1990 | Lappanen et al. | |
| 4,981,745 | A | 1/1991 | Lefkowitz | 428/147 |
| 5,066,532 | A | 11/1991 | Gaisser | 428/137 |
| 5,084,326 | A | 1/1992 | Vohringer | |
| 5,121,329 | A | 6/1992 | Crump | 364/468 |
| 5,136,515 | A | 8/1992 | Helsinki | 364/468 |
| 5,238,537 | A | 8/1993 | Dutt | 162/358.4 |
| 5,240,531 | A | 8/1993 | Toda et al. | 156/137 |
| 5,277,761 | A | 1/1994 | Van Phan et al. | 162/109 |
| 5,292,438 | A | 3/1994 | Lee | |
| 5,298,124 | A | 3/1994 | Eklund et al. | 162/306 |
| 5,360,656 | A | 11/1994 | Rexfelt et al. | 428/193 |
| 5,397,438 | A | 3/1995 | Nyberg et al. | 162/207 |
| 5,422,166 | A | 6/1995 | Fleischer | |
| 5,462,642 | A | 10/1995 | Kajander | 162/116 |
| 5,506,607 | A | 4/1996 | Sanders, Jr. et al. | 347/1 |
| 5,515,779 | A | 5/1996 | Danby | |
| 5,518,680 | A | 5/1996 | Cima et al. | |
| 5,556,509 | A | 9/1996 | Trokhan et al. | 162/111 |
| 5,672,248 | A | 9/1997 | Wendt et al. | 162/109 |
| 5,679,222 | A | 10/1997 | Rasch et al. | 162/358.1 |
| 5,713,399 | A | 2/1998 | Collette et al. | 139/383 |
| 5,714,041 | A * | 2/1998 | Ayers et al. | 162/111 |
| 5,731,059 | A | 3/1998 | Smith et al. | 428/192 |
| 5,733,608 | A | 3/1998 | Kessel et al. | 427/547 |
| 5,740,051 | A | 4/1998 | Sanders, Jr. et al. | 364/468.26 |
| 5,746,887 | A | 5/1998 | Wendt et al. | 162/109 |
| 5,787,602 | A | 8/1998 | Hsu et al. | 34/116 |
| 5,804,036 | A | 9/1998 | Phan et al. | |
| 5,817,374 | A | 10/1998 | Detig et al. | 427/466 |
| 5,817,377 | A | 10/1998 | Trokhan et al. | |
| 5,829,488 | A | 11/1998 | Fagerholm et al. | 139/383 |
| 5,849,395 | A | 12/1998 | Valentine et al. | |
| 5,936,861 | A | 8/1999 | Jang et al. | 364/468.04 |
| 6,080,691 | A | 6/2000 | Lindsay et al. | 442/381 |
| 6,099,781 | A | 8/2000 | Ampulski | |
| 6,120,642 | A | 9/2000 | Lindsay et al. | 162/109 |
| 6,136,151 | A | 10/2000 | Davenport et al. | 162/306 |
| 6,136,157 | A | 10/2000 | Lindeberg et al. | 204/157.6 |
| 6,193,847 | B1 | 2/2001 | Trokhan | |
| 6,251,331 | B1 | 6/2001 | Ampulski | 264/510 |
| 6,340,413 | B1 | 1/2002 | Nilsson et al. | 162/361 |
| 6,344,241 | B1 * | 2/2002 | Ampulski | 427/286 |
| 6,350,336 | B1 | 2/2002 | Paquin | 156/93 |
| 6,358,030 | B1 | 3/2002 | Ampulski | |
| 6,358,594 | B1 | 3/2002 | Ampulski | |
| 6,398,910 | B1 | 6/2002 | Burazin et al. | |
| 6,419,795 | B1 | 7/2002 | Dutt | |
| 6,576,090 | B1 * | 6/2003 | Trokhan et al. | 162/348 |
| 2001/0035598 | A1 | 11/2001 | Ampulski | |
| 2002/0107495 | A1 | 8/2002 | Chen et al. | |

FOREIGN PATENT DOCUMENTS

| | | | |
|---|---|---|---|
| EP | 0 487 477 | | 5/1992 |
| EP | 0 568 509 | | 11/1993 |
| EP | 0 613 729 | | 9/1994 |
| EP | 0 677 612 | A2 | 10/1995 |
| GB | 1 053 282 | | 5/1963 |
| WO | WO 92/00415 | | 1/1992 |
| WO | WO 93/00474 | | 1/1993 |
| WO | WO 96/35018 | | 11/1996 |
| WO | WO 97/14846 | | 4/1997 |
| WO | WO 99/35332 | | 7/1999 |
| WO | WO 00/09308 | | 2/2000 |
| WO | WO 02/088464 | A1 | 11/2002 |
| WO | WO 2004/045834 | A1 | 6/2004 |

* cited by examiner

METHOD FOR MANUFACTURING RESIN-IMPREGNATED ENDLESS BELT STRUCTURES FOR PAPERMAKING MACHINES AND SIMILAR INDUSTRIAL APPLICATIONS AND BELT

BACKGROUND OF THE INVENTION

1. Field of the Invention

The present invention relates, in part, to mechanisms for extracting water from a web of material, and, more particularly, from a fibrous web being processed into a paper product on a papermaking machine. Specifically, the present invention is a method for manufacturing resin impregnated endless belt structures designed for use on a long nip press of the shoe type on a papermaking machine, and for other papermaking and paper-processing applications.

2. Description of the Prior Art

During the papermaking process, a fibrous web of cellulosic fibers is formed on a forming fabric by depositing a fibrous slurry thereon in the forming section of a paper machine. A large amount of water is drained from the slurry in the forming section, after which the newly formed web is conducted to a press section. The press section includes a series of press nips, in which the fibrous web is subjected to compressive forces applied to remove water therefrom. The web finally is conducted to a drying section which includes heated dryer drums around which the web is directed. The heated dryer drums reduce the water content of the web to a desirable level through evaporation to yield a paper product.

Rising energy costs have made it increasingly desirable to remove as much water as possible from the web prior to its entry into the dryer section. As the dryer drums are typically heated from within by steam, costs associated with steam production may be substantial, especially when a large amount of water must be removed from the web.

Traditionally, press sections have included a series of nips formed by pairs of adjacent cylindrical press rolls. In recent years, the use of long press nips of the shoe type has been found to be more advantageous than the use of nips formed by pairs of adjacent press rolls. This is because the longer the time a web can be subjected to pressure in the nip, the more water can be removed there, and, consequently, the less water will remain behind in the web for removal through evaporation in the dryer section.

The present invention relates, in part, to long nip presses of the shoe type. In this variety of long nip press, the nip is formed between a cylindrical press roll and an arcuate pressure shoe. The latter has a cylindrically concave surface having a radius of curvature close to that of the cylindrical press roll. When the roll and shoe are brought into close physical proximity to one another, a nip, which can be five to ten times longer in the machine direction than one formed between two press rolls, is formed. Since the long nip may be five to ten times longer than that in a conventional two-roll press, the so-called dwell time, during which the fibrous web is under pressure in the long nip, may be correspondingly longer than it would be in a two-roll press. The result is a dramatic increase in the dewatering of the fibrous web in the long nip relative to that obtained using conventional nips on paper machines.

A long nip press of the shoe type requires a special belt, such as that shown in U.S. Pat. No. 5,238,537 to Dutt (Albany International Corp.), the teachings of which are incorporated herein by reference. The belt is designed to protect the press fabric, which supports, carries and dewaters the fibrous web, from the accelerated wear that would result from direct, sliding contact over the stationary pressure shoe. Such a belt must be provided with a smooth, impervious surface that rides, or slides, over the stationary shoe on a lubricating film of oil. The belt moves through the nip at roughly the same speed as the press fabric, thereby subjecting the press fabric to minimal amounts of rubbing against the surface of the belt.

Belts of the variety shown in U.S. Pat. No. 5,238,537 are made by impregnating a woven base fabric, which takes the form of an endless loop, with a synthetic polymeric resin. Preferably, the resin forms a coating of some predetermined thickness on at least the inner surface of the belt, so that the yarns from which the base fabric is woven may be protected from direct contact with the arcuate pressure shoe component of the long nip press. It is specifically this coating which must have a smooth, impervious surface to slide readily over the lubricated shoe and to prevent any of the lubricating oil from penetrating the structure of the belt to contaminate the press fabric, or fabrics, and fibrous web. The base fabric of the belt shown in U.S. Pat. No. 5,238,537 may be woven from monofilament yarns in a single or multilayer weave, and is woven so as to be sufficiently open to allow the impregnating material to totally impregnate the weave. This eliminates the possibility of any voids forming in the final belt. Such voids may allow the lubrication used between the belt and shoe to pass through the belt and contaminate the press fabric or fabrics and fibrous web. The base fabric may be flat woven, and subsequently seamed into endless form, or woven endless in tubular form.

When the impregnating material is cured to a solid condition, it is primarily bound to the base fabric by a mechanical interlock, wherein the cured impregnating material surrounds the yarns of the base fabric. In addition, there may be some chemical bonding or adhesion between the cured impregnating material and the material of the yarns of the base fabric.

Long nip press belts, such as that shown in U.S. Pat. No. 5,238,537, depending on the size requirements of the long nip presses on which they are installed, have lengths from roughly 10 to 35 feet (approximately 3 to 11 meters), measured longitudinally around their endless-loop forms, and widths from roughly 6 to 35 feet (approximately 2 to 11 meters), measured transversely across those forms. The manufacture of such belts is complicated by the requirement that the base fabric be endless prior to its impregnation with a synthetic polymeric resin.

It is often desirable to provide the belt with a resin coating of some predetermined thickness on its outer surface as well as on its inner surface. By coating both sides of the belt, its woven base fabric will be closer to, if not coincident with, the neutral axis of bending of the belt. In such a circumstance, internal stresses which arise when the belt is flexed on passing around a roll or the like on the paper machine will be less likely to cause the coating to delaminate from either side of the belt.

Moreover, when the outer surface of the belt has a resin coating of some predetermined thickness, it permits grooves, blind-drilled holes or other cavities to be formed on that surface without exposing any part of the woven base fabric. These features provide for the temporary storage of water pressed from the web in the press nip, and are usually produced by grooving or, drilling in a separate manufacturing step following the curing of the resin coating.

The present invention provides a solution to this particular problem, that is, the necessity for a separate manufacturing step or steps, which characterizes prior-art methods for manufacturing resin impregnated endless belt structures having void volume in the form of grooves, blind-drilled holes and the like on their outer surfaces. Moreover, the present invention provides an alternate method for manufacturing resin impregnated endless belt structures used in other papermaking and paper processing applications, such as calender and transfer belts. For example, U.S. Pat. No. 5,298,124 shows a sheet-transfer belt designed for use in eliminating an open draw on a paper machine. The belt has a reinforcing base and a polymer coating on the paper supporting side of the reinforcing base. The polymer coating may be a mixture of two or more different polymeric resin materials, such as, for example, a hydrophilic material and a hydrophobic material, each of which forms microscopic regions on the surface of the transfer belt.

Ultimately, the quality of the transfer belt, as determined by the size and uniformity with which the polymeric resin materials can be mixed. The present invention also provides a solution to this problem in the form of an alternate method to provide the surface of a transfer belt with microscopic regions of differing character in a predictable and reproducible manner.

SUMMARY OF THE INVENTION

Accordingly, the present invention is a method for manufacturing a resin impregnated endless belt structure designed for use on a long nip press on a papermaking machine and for other papermaking and paper processing applications. The method comprises a first step of providing a base substrate for the belt. The base substrate may be one which has previously been impregnated with a polymeric resin material which forms a layer on its inner or outer surface. Alternatively, the base substrate may be rendered impermeable by depositing a polymeric resin material onto the base substrate to coat its entire surface during the practice of the present invention.

In any case, polymeric resin material is deposited onto the base substrate in a precise predetermined pattern, which predetermined pattern is to characterize the surface of the belt being manufactured. The polymeric resin material forms a layer of desired thickness in the predetermined pattern over any previously applied. The polymeric resin material is deposited in droplets having an average diameter of 10μ (10 microns) or more. At least one piezojet may be used to deposit the polymeric resin material onto the base substrate, although other means for depositing droplets of that size may be known to those of ordinary skill in the art or may be developed in the future and used instead of a piezojet. The polymeric resin material is then set or fixed by appropriate means.

Subsequently, the coating of polymeric resin material may optionally be abraded to provide it with a uniform thickness and a smooth, macroscopically monoplanar surface.

The present invention will now be described in more complete detail, with frequent reference being made to the figures identified below.

DETAILED DESCRIPTION OF THE PREFERRED EMBODIMENTS

Figure 1:
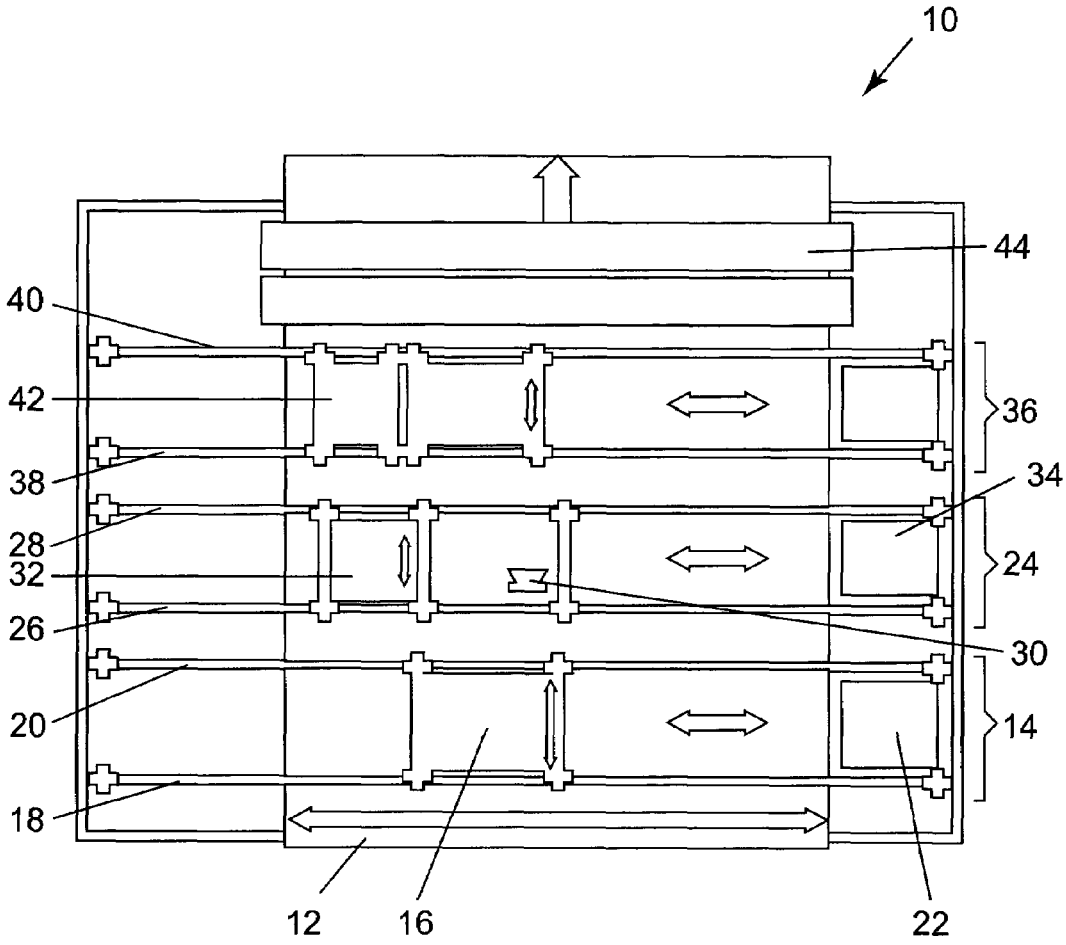
FIG. 1 is a schematic view of an apparatus used to manufacture belts according to the method of the present invention.

The method for fabricating a belt in accordance with the present invention begins with the provision of a base substrate. Typically, the base substrate is a fabric woven from monofilament yarns. More broadly, however, the base substrate may be a woven, nonwoven, spiral-link or knitted fabric comprising yarns of any of the varieties used in the production of paper machine clothing or of belts used to manufacture nonwoven articles and fabrics, such as monofilament, plied monofilament, multifilament and plied multifilament yarns. These yarns may be obtained by extrusion from any of the polymeric resin materials used for this purpose by those of ordinary skill in the art. Accordingly, resins from the families of polyamide, polyester, polyurethane, polyaramid, polyolefin and other resins may be used.

Alternatively, the base substrate may be composed of mesh fabrics, such as those shown in commonly assigned U.S. Pat. No. 4,427,734 to Johnson, the teachings of which are incorporated herein by reference. The base substrate may further be a spiral-link belt of the variety shown in many U.S. patents, such as U.S. Pat. No. 4,567,077 to Gauthier, the teachings of which are also incorporated herein by reference.

Moreover, the base substrate may be produced by spirally winding a strip of woven, nonwoven, knitted or mesh fabric in accordance with the methods shown in commonly assigned U.S. Pat. No. 5,360,656 to Rexfelt et al., the teachings of which are incorporated herein by reference. The base substrate may accordingly comprise a spirally wound strip, wherein each spiral turn is joined to the next by a continuous seam making the base substrate endless in a longitudinal direction. The above should not be considered to be the only possible forms for the base substrate. Any of the varieties of base substrate used by those of ordinary skill in the paper machine clothing and related arts may alternatively be used.

Once the base substrate has been provided, one or more layers of staple fiber batt may optionally be attached to one or both of its two sides by methods well known to those of ordinary skill in the art. Perhaps the best known and most commonly used method is that of needling, wherein the individual staple fibers in the batt are driven into the base substrate by a plurality of reciprocating barbed needles. Alternatively, the individual staple fibers may be attached to the base substrate by hydroentangling, wherein fine high-pressure jets of water perform the same function as the above-mentioned reciprocating barbed needles. It will be recognized that, once staple fiber batt has been attached to the base substrate by either of these or other methods known by those of ordinary skill in the art, one would have a structure identical to that of a press fabric of the variety generally used to dewater a wet paper web in the press section of a paper machine.

In some cases, it may be necessary to apply an initial layer or additional batt to the structure after application of the resin. In such cases the patterned resin may lie below a layer of batt fibers.

Alternatively still, the base substrate may be a structure which has been rendered impermeable to fluids, such as air and water, with a coating of a polymeric resin material, which at least partially impregnates the structure and which may form a layer of a desired thickness on one of its two sides. This is particularly the case where the belt is intended for use on a long nip press, and requires a layer of polymeric resin material of some predetermined thickness on its inner surface, so that the base substrate may be protected from direct contact with the arcuate pressure shoe component of the long nip press. The belts manufactured in accordance with the present invention may be used as long nip press belts for long nip presses of the shoe type, and for other papermaking and paper-processing applications, such as calendering and sheet transfer.

Once the base substrate, with or without the addition of staple fiber batt material, and with or without a layer of polymeric resin material of desired thickness on one of its two sides, has been provided, it is mounted on the apparatus 10 shown schematically in FIG. 1. It should be understood that the base substrate may be either endless or seamable into endless form during installation on a paper machine. As such, the base substrate 12 shown in FIG. 1 should be understood to be a relatively short portion of the entire length of the base substrate 12. Where the base substrate 12 is endless, it would most practically be mounted about a pair of rolls, not illustrated in the figure but most familiar to those of ordinary skill in the paper machine clothing arts. In such a situation, apparatus 10 would be disposed on one of the two runs, most conveniently the top run, of the base substrate 12 between the two rolls. Whether endless or not, however, the base substrate 12 is preferably placed under an appropriate degree of tension during the process. Moreover, to prevent sagging, the base substrate 12 may be supported from below by a horizontal support member as it moves through apparatus 10.

Referring now more specifically to FIG. 1, where the base substrate 12 is indicated as moving in an upward direction through the apparatus 10 as the method of the present invention is being carried out, apparatus 10 comprises a sequence of several stations through which the base substrate 12 may pass incrementally as a belt is being manufactured therefrom.

The stations are identified as follows:

1. polymer deposition station 14;
2. imaging/repair station 24;
3. optional setting station 36; and
4. optional grinding station 44.

In accordance with the present invention, it may be desired, where the base substrate 12 has not previously been rendered impermeable to fluids, such as air and water, with a coating of a polymeric resin material which at least partially impregnates the base substrate 12, to coat the entire surface of the base substrate 12 to render the base substrate 12 impermeable. This may be accomplished by using the first station, polymer deposition station 14, of apparatus 10.

In the polymer deposition station 14, a piezojet array 16 mounted on transverse rails 18, 20 and translatable thereon in a direction transverse to that of the motion of the base substrate 12 through the apparatus 10, as well as therebetween in a direction parallel to that of the motion of the base substrate 12, may be used to deposit in repeated steps to build up the desired amount of polymeric resin material onto or within the base substrate 12 to render it impermeable and, optionally, to form a layer of desired thickness thereover while the base substrate 12 is at rest. An alternate metering device, such as a bulk-jet array, mounted on polymer deposition station 14, may also be used for this purpose. One or more passes over the base substrate 12 may be made by the piezojet array 16 or alternate metering device to deposit the desired amount of polymeric resin material.

Once this has been done, if desired, the piezojet array 16 is used to deposit polymeric resin material onto the base substrate 12 in a predetermined pattern. Alternatively, as previously noted, other means for depositing the small droplets required for the practice of the present invention, as will be discussed below, may be known to those of ordinary skill in the art or may be developed in the future, and may be used in the practice of the present invention. The polymeric resin material forms a layer of desired thickness in the predetermined pattern over any previously applied polymeric resin material. That pattern may be a continuous network extending substantially throughout both dimensions of the surface of the base substrate 12 and defining an array of discrete open areas which are to be ultimate locations of a corresponding array of discrete holes providing void volume on the surface of the belt.

Alternatively, the polymeric resin material may be deposited in a semicontinuous network, for example, a semicontinuous pattern extending substantially throughout the base substrate 12 in an essentially linear fashion, thereby forming lines which are generally parallel and equally spaced from one another. Such lines may be either straight or zigzag. More generally, a semicontinuous network comprises straight or curved lines, or lines having both straight and curved segments, which are spaced apart from one another and do not cross one another. Ultimately, the semicontinuous network provides the surface of the completed belt with a plurality of grooves, which may provide void volume for the temporary storage of water pressed from a wet paper sheet.

Alternatively still, the polymeric resin material may be deposited in an array of discrete locations so as to define, for example, crisscrossing grooves.

In each case, the polymeric resin material rises to a predetermined height over any previously applied polymeric resin material at the locations where it is deposited. As such, the polymeric resin material could ultimately reside entirely within the surface plane of the base substrate 12, even with the surface plane of the base substrate 12, or above the surface plane of the base substrate 12. One or more passes over the base substrate 12 may be made by the piezojet array 16 to deposit the desired amount of polymeric resin material.

It should be understood that these two operations, namely, the coating of the base substrate 12 with polymeric resin material to render it impermeable and the deposition of additional polymeric resin material thereon in a predetermined pattern, may be carried on in a single operation. In other words, the polymer deposition station 14 may be used to coat the base substrate 12 with polymeric resin material to some preselected thickness, and then to apply additional polymeric resin material thereover in a predetermined pattern, instead of, for example, coating the entire base substrate 12 first and then, in a subsequent operation, applying additional polymeric resin material in a predetermined pattern.

It should also be understood that, in some applications, the predetermined pattern may be one in which the surface of the belt is made visually smooth and uniform, but has microscopic regions, each formed by one of two or more different polymeric resin materials.

In addition the deposit of the material need not only be traversing the movement of the base substrate but can be parallel to such movement, spiral to such movement or in any other manner suitable for the purpose.

The piezojet array 16 comprises at least one but preferably a plurality of individual computer-controlled piezojets, each functioning as a pump whose active component is a piezoelectric element. As a practical matter, an array of up to 256 piezojets or more may be utilized if the technology permits. The active component is a crystal or ceramic which is physically deformed by an applied electric signal. This deformation enables the crystal or ceramic to function as a pump, which physically ejects a drop of a liquid material each time an appropriate electric signal is received. As such, this method of using piezojets to supply drops of a desired material in response to computer-controlled electric signals is commonly referred to as a "drop-on-demand" method.

Referring again to FIG. 1, the piezojet array 16, starting from an edge of the base substrate 12, or, preferably, from a reference thread extending lengthwise therein, translates lengthwise and widthwise across the base substrate 12, while the base substrate 12 is at rest, deposits the polymeric resin material in the form of extremely small droplets having a nominal diameter of 10μ (10 microns) or more, such as 50μ (50 microns), and 100μ (100 microns), in one of the above-described patterns. The translation of the piezojet array 16 lengthwise and widthwise relative to the base substrate 12, and the deposition of droplets of the polymeric resin material from each piezojet in the array 16, are controlled in a controlled manner to control the geometry in three planes, length, width and depth or height (x, y, z dimensions or directions) of the pattern being formed by computer to produce, repeatedly so as to build up the desired amount of material in the desired shape the predetermined pattern of the polymeric resin material within, and, when desired, on the base structure 12. One or more passes over the base substrate 12 may be made by the piezojet array 16 to deposit the desired amount of polymeric resin material.

In the present invention, in which a piezojet array is used to deposit a polymeric resin material onto or within selected areas of the surface of the base substrate 12, the choice of polymeric resin material is limited by the requirement that its viscosity be 100 cps (100 centipoise) or less at the time of delivery, that is, when the polymeric resin material is in the nozzle of a piezojet ready for deposition, so that the individual piezojets can provide the polymeric resin material at a constant drop delivery rate. A second requirement limiting the choice of polymeric resin material is that it must partially set during its fall, as a drop, from a piezojet to the base substrate 12, or after it lands on the base substrate 12, to prevent the polymeric resin material from flowing and to maintain control over the polymeric resin material to ensure its deposition in the desired pattern. Suitable polymeric resin materials which meet these criteria are:

1. Hot melts and moisture-cured hot melts;
2. Two-part reactive systems based on urethanes and epoxies;
3. Photopolymer compositions consisting of reactive acrylated monomers and acrylated oligomers derived from urethanes, polyesters, polyethers, and silicones; and
4. Aqueous-based latexes and dispersions and particle-filled formulations including acrylics and polyurethanes.

As noted above, the piezojet array 16 is capable of supplying the polymeric resin material in the form of extremely small droplets having an average diameter of 100μ (10 microns) or more, so long as its viscosity is less than 100 cps (100 centipoise) at the time of delivery. Moreover, the piezojet array 16 can deposit the polymeric resin material with great precision one layer at a time, making it unnecessary to grind the surface of a layer formed thereby on the base substrate 12 to achieve a uniform thickness, and enables one of ordinary skill in the art to control the z-direction geometry of the polymeric resin material. That is to say, the piezojet array 16 can deposit the polymeric resin material with such precision that the surface will be monoplanar without having to be ground or, alternatively, that the surface will have some predetermined three-dimensional structure. Further, some of the individual piezojets in the piezojet array may be used to deposit one polymeric resin material, while others may be used to deposit a different polymeric resin material, to produce a surface having microscopic regions of more than one type of polymeric resin material. As discussed above, this approach may be taken to manufacture a sheet-transfer belt whose surface has microscopic regions of more than one polymeric resin material, such as, for example, a hydrophilic material and a hydrophobic material.

The degree of precision of the jet in depositing the material will depend upon the dimensions and shape of the structure being formed. The type of jet used and the viscosity of the material being applied will also impact the precision of the jet selected.

Moreover, in an alternative embodiment of the present invention, the piezojet array 16 may include one or more bulk jets, which deposit polymeric resin material onto the base substrate 12, at a rate greater than that at which it can be deposited by piezojets. The choice of the polymeric resin material to be deposited by the bulk jets is not governed by the viscosity requirement for the polymeric resin material being deposited by the piezojets. As such, a wider variety of polymeric resin materials, such as some polyurethane and photosensitive resins, may be deposited using the bulk jets. In practice, the bulk jets are used to deposit the "bulk" of the polymeric resin material onto the base substrate 12 at crude resolution, while the piezojets are used to refine the details of the pattern produced by the polymeric resin material on the base substrate 12 at higher resolution. The bulk jets may operate prior to or simultaneously with the piezojets. In this manner, the entire process of providing a base substrate 12 with a pattern of a polymeric resin material proceeds more quickly and efficiently. One or more passes over the base substrate 12 may be made by the piezojet array 16 and the bulk jets to deposit the desired amount of polymeric resin material.

It should be understood that the polymeric resin material needs to be fixed on or within the base substrate 12 following its deposition thereon. The means by which the polymeric resin material is set or fixed depends on its own physical and/or chemical requirements. Photopolymers are cured with light, whereas hot-melt materials are set by cooling. Aqueous-based latexes and dispersions are dried and then cured with heat, and reactive systems are cured by heat. Accordingly, the polymeric resin materials may be set by curing, cooling, drying or any combination thereof.

The proper fixing of the polymeric resin material is required to control its penetration into and distribution within the base substrate 12, that is, to control and confine the material within the desired volume of the base substrate 12. Such control is important below the surface plane of the base substrate 12 to prevent wicking and spreading. Such control may be exercised, for example, by maintaining the base substrate 12 at a temperature which will cause the polymeric resin material to set quickly upon contact. Control may also be exercised by using such materials having well known or well defined curing or reaction times on base substrates having a degree of openness such that the polymeric resin material will set before it has time to spread beyond the desired volume of the base substrate 12.

When the pattern has been completed in a band between the transverse rails 18,20 across the base substrate 12, the base substrate 12 is advanced lengthwise an amount equal to the width of the band, and the procedure described above is repeated to produce the predetermined pattern in a new band adjacent to that previously completed. In this repetitive manner, the entire base substrate 12 can be provided with the predetermined pattern.

Alternatively, the piezojet array 16, again starting from an edge of the base substrate 12, or, preferably, from a reference thread extending lengthwise therein, is kept in a fixed position relative to the transverse rails 18,20, while the base substrate 12 moves beneath it, to deposit the polymeric resin material in the desired pattern in a lengthwise strip around the base substrate 12. Upon completion of the lengthwise strip, the piezojet array 16 is moved widthwise on transverse rails 18,20 an amount equal to the width of the lengthwise strip, and the procedure described above is repeated to produce the predetermined pattern in a new lengthwise strip adjacent to that previously completed. In this repetitive manner, the entire base substrate 12 can be provided with the predetermined pattern.

Figure 7:
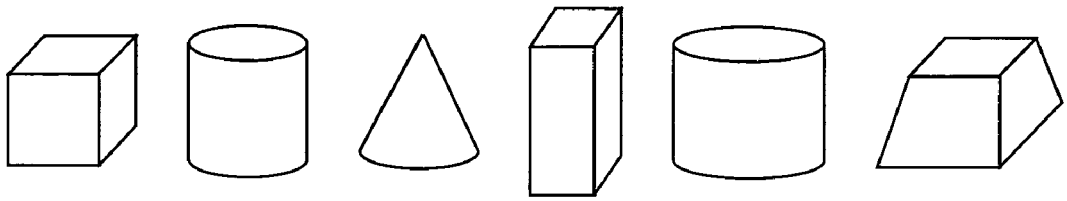
FIG. 7 is a perspective view of a variety of representation shapes of the deposited material.

One or more passes over the base substrate 12 may be made by piezojet array 16 to deposit the desired amount of material and to create the desired shape. In this regard, the deposits can take any number of shapes as illustrated generally in FIG. 7. The shapes can be square, round conical, rectangular, oval, trapezoidal etc. with a thicker base tapering upward. Depending upon the design chosen, the amount of material deposited can be layered in decreasing fashion as the jet repeatedly passes over the deposit area.

At one end of the transverse rails 18,20, a jet check station 22 is provided for testing the flow of polymeric resin material from each jet. There, the jets can be purged and cleaned to restore operation automatically to any malfunctioning jet unit. In the second station, the imaging/repair station 24, transverse rails 26,28 support a digital-imaging camera 30, which is translatable across the width of base substrate 12, and a repair jet array 32, which is translatable both across the width of the base substrate 12 and lengthwise relative thereto between transverse rails 26,28, while the base substrate 12 is at rest.

The digital-imaging camera 30 views the deposited polymeric resin material to locate any faulty or missing discrete elements or similar irregularities in a semicontinuous or continuous pattern produced thereby on the base substrate 12. Comparisons between the actual and desired patterns are made by a fast pattern recognizer (FPR) processor operating in conjunction with the digitalimaging camera 30. The FPR processor signals the repair jet array 32 to deposit additional polymeric resin material onto the elements detected to be faulty or missing. As before, at one end of the transverse rails 26,28, a repair jet check station 34 is provided for testing the flow of material from each repair jet. There, each repair jet can be purged and cleaned to restore operation automatically to any malfunctioning repair jet unit.

In the third station, the optional setting station 36, transverse rails 38,40 support a setting device 42, which may be required to set the polymeric resin material being used. The setting device 42 may be a heat source, for example, an infrared, hot air, microwave or laser source; cold air; or an ultraviolet or visiblelight source, the choice being governed by the requirements of the polymeric resin material being used.

Finally, the fourth and last station is the optional grinding station 44, where an appropriate abrasive is used to provide any polymeric resin material above the surface plane of the base substrate 12 with a uniform thickness and a smooth, macroscopically monoplanar surface. The optional grinding station 44 may comprise a roll having an abrasive surface, and another roll or backing surface on the other side of the base substrate 12 to ensure that the grinding will result in a uniform thickness and a smooth, macroscopically monoplanar surface.

Figure 2:
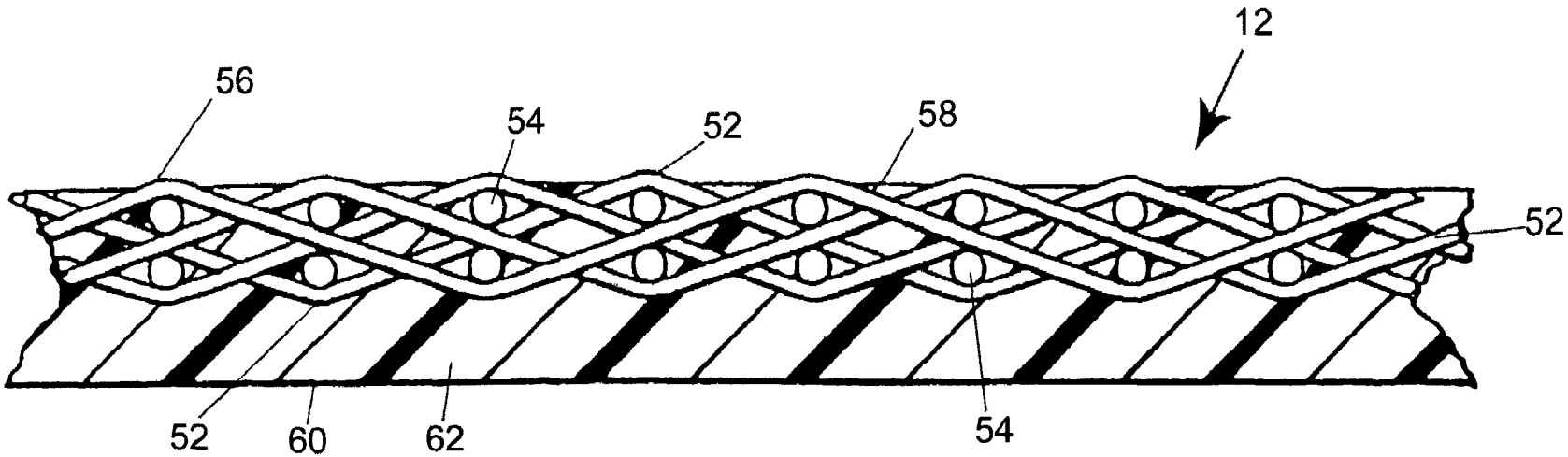
FIG. 2 is a cross-sectional view of a base substrate having a layer of polymeric resin material on its inner surface.

As an example, reference is now made to FIG. 2, which is a cross-sectional view of a base substrate 12 having a layer of polymeric resin material on its inner surface. The base substrate 12 is woven from lengthwise yarns 52 and crosswise yarns 54 in a multilayer weave. Knuckles 56 appearing on the surface of the base substrate 12 where lengthwise yarns 52 weave over crosswise yarns 54 may be visible on the outer surface 58 of the base substrate 12. The inner surface 60 of the base substrate 12 is formed by a polymeric resin coating 62.

The polymeric resin coating 62 protects the base substrate 12 from sliding contact and the wear by abrasion that would result when the inner surface 60 slides across a lubricated arcuate pressure shoe of a long nip press. The polymeric resin also impregnates the base substrate 12 rendering it impermeable to oil and water. The polymeric resin coating 62 maybe of polyurethane, and is preferably a 100' solids composition thereof to avoid the formation of bubbles during the curing process through which the polymeric resin proceeds following its application onto the base substrate 12. After curing, the polymeric resin coating 62 is ground and buffed to provide it with a smooth surface and a uniform thickness.

Figure 3:
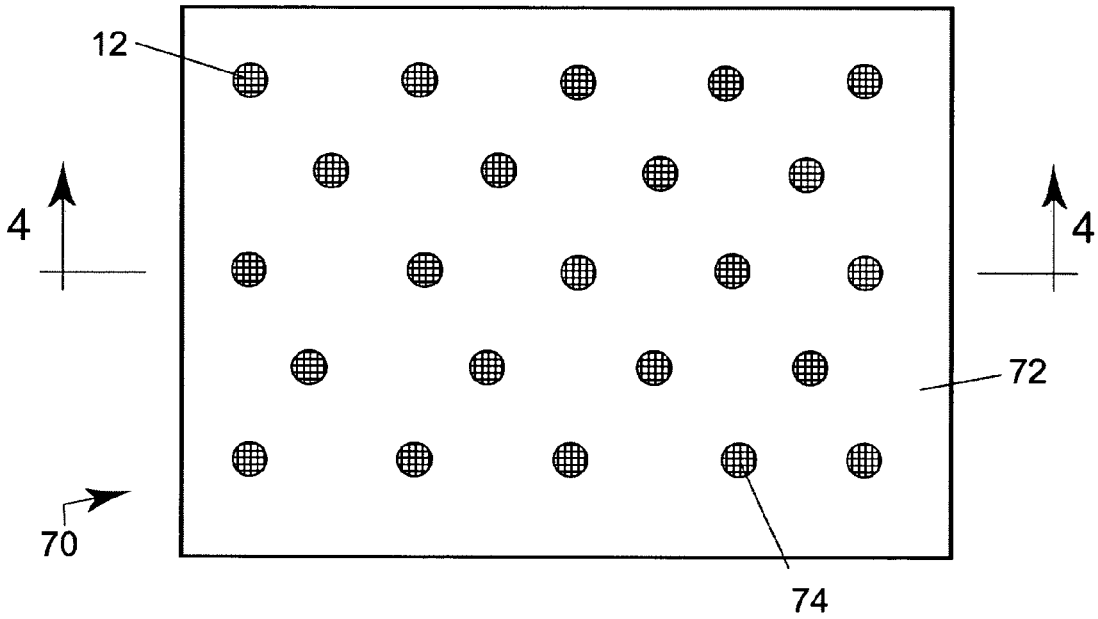
FIG. 3 is a plan view of a completed belt as it would appear upon exit from the apparatus of FIG. 1.

FIG. 3 is a plan view of a completed belt 70 as it would appear upon exit from optional setting station 36 and the optional grinding station 44 of apparatus 10. The belt 70 has a coating of polymeric resin material 72 except for a plurality of discrete holes 74 in a predetermined pattern.

Note the pattern can be random, a repeating random pattern on a base substrate or such patterns that are repeatable from belt to belt for quality control.

Figure 4:
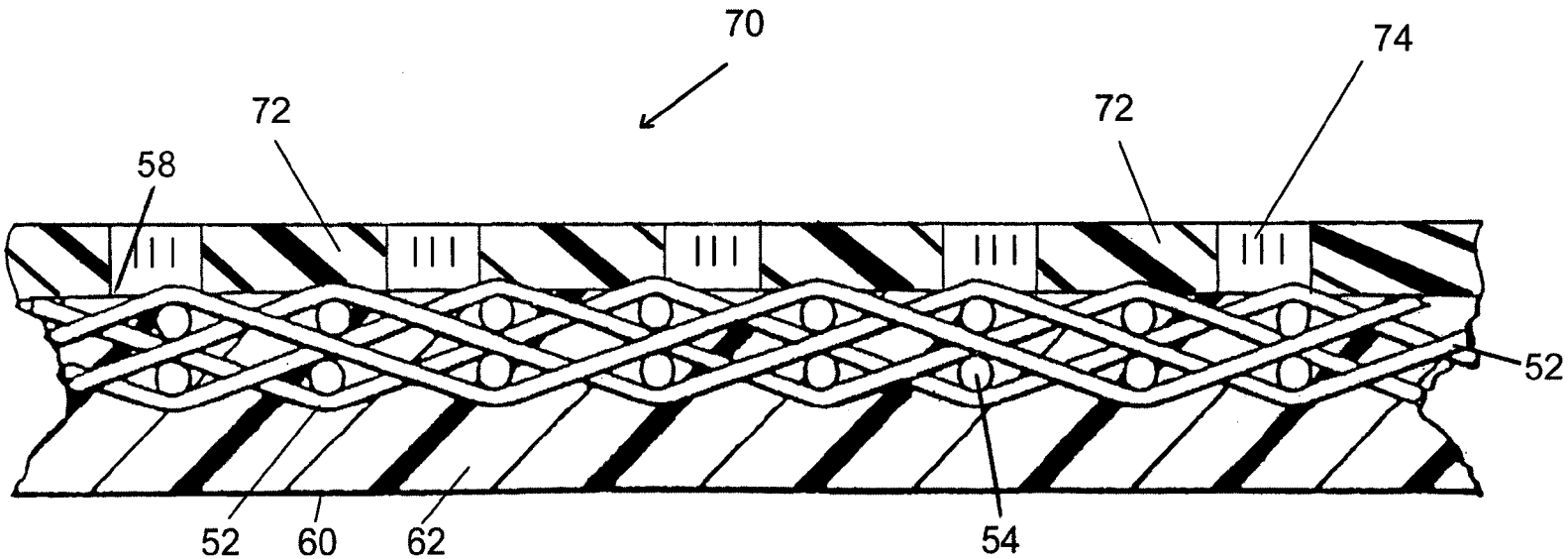
FIG. 4 is a cross-sectional view taken as indicated in FIG. 3.

FIG. 4 is a cross-sectional view of a completed belt taken as indicated in FIG. 3. In this example, polymeric resin material 72 forms a layer of desired thickness over the base substrate 12, except for the areas represented by the discrete holes 74.

Figure 5:
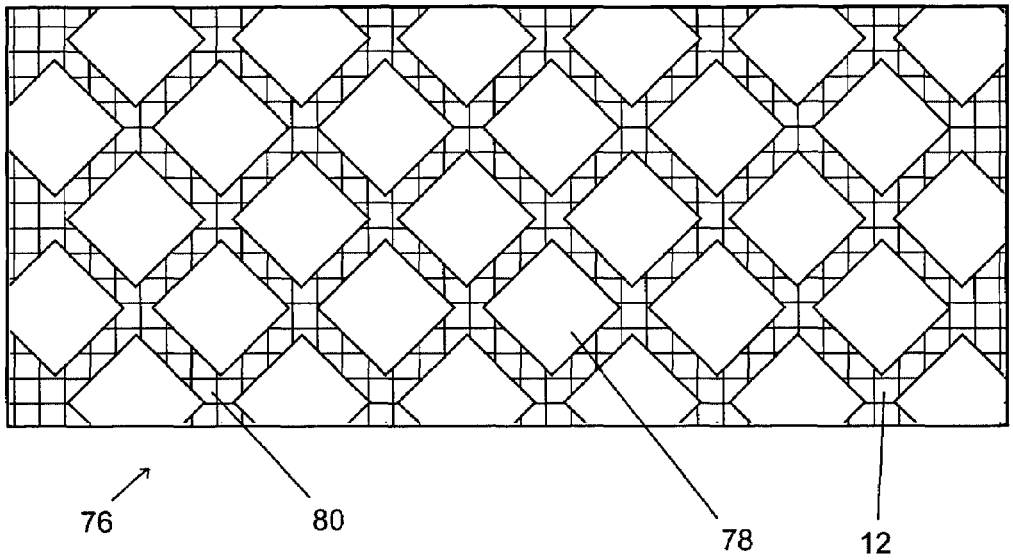
FIG. 5 is a plan view of a second embodiment of the belt.
Figure 6:
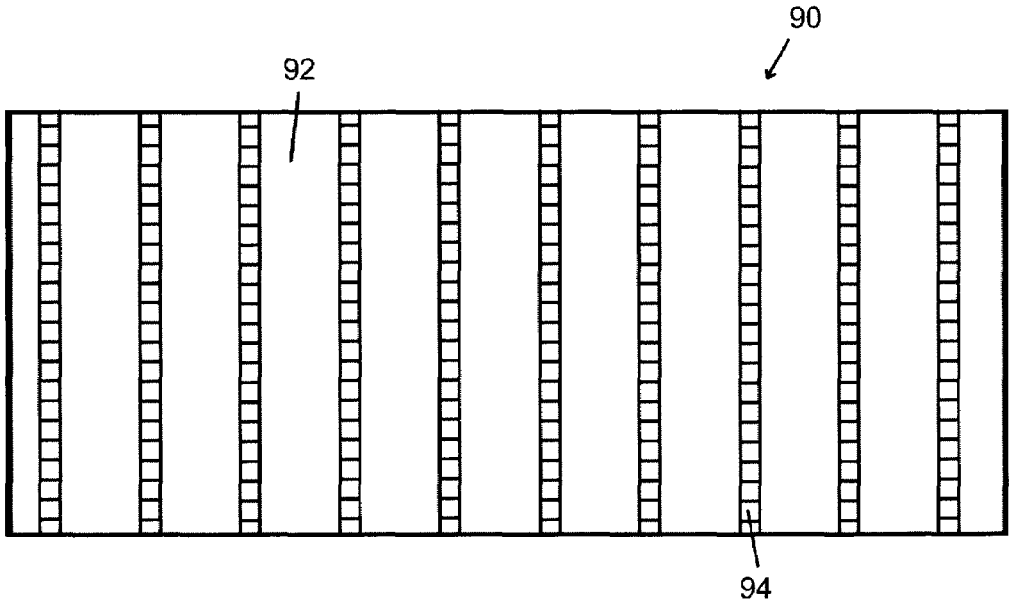
FIG. 6 is a plan view of a third embodiment of the belt.

Alternative embodiments of the belt are shown in FIGS. 5 and 6. FIG. 5 is a plan view of a belt 76 whose base substrate 12 has a plurality of discrete areas 78 of polymeric resin material in a predetermined array on 5 its outer surface providing the surface of the belt 76 with a plurality of crisscrossing grooves 80.

FIG. 6 is a plan view of a belt 90 having a semicontinuous network of polymeric resin material on its surface. The semicontinuous network extends substantially throughout the belt 90 in an essentially linear fashion. Each portion 92 of the semicontinuous network extends in a substantially straight line parallel to others making up the network. Each portion 92 is of polymeric resin material, and is a land area which, with portions 92 adjacent thereto, define grooves 94 therebetween.

In an alternate embodiment of the present invention, the polymer deposition station 14, the imaging/repair station 24, and the setting station 36 may be adapted to produce a belt from the base substrate 12 in a spiral technique, rather than indexing in the cross-machine direction as described above. In a spiral technique, the polymer deposition station 14, the imaging/repair station 24, and the setting station 36 start at one edge of the base substrate 12, for example, the left-hand edge in FIG. 1, and are gradually moved across the base substrate 12, as the base substrate 12 moves in the direction indicated in FIG. 1. The rates at which the stations 14, 24, 36 and the base substrate 12 are moved are set so that the pattern desired in the finished belt is spiraled onto the base substrate 12 in a continuous manner. In this alternative, the polymeric resin material deposited by the polymer deposition station 14 and imaging/repair station 24 may be partially set or fixed as each spiral passes beneath the setting device 42, and completely set when the entire base substrate 12 has been processed through the apparatus 10.

Alternatively, where the piezojet array 16 deposits the polymeric resin material in the desired pattern in a lengthwise strip around the base substrate 12, the imaging/repair station 24 and the setting station 36 may also be kept in a fixed position aligned with the piezojet array 16, while the base substrate 12 moves beneath them, so that the pattern desired in the finished belt is applied to a lengthwise strip around the base substrate 12. Upon completion of the lengthwise strip, the piezojet array 16, the imaging/repair station 24 and the setting station 36 are moved widthwise an amount equal to the width of the lengthwise strip, and the procedure is repeated for a new lengthwise strip adjacent to that previously completed. In this repetitive manner the entire base structure 12 can be completely coated.

Furthermore, the entire apparatus can remain in a fixed position with the material processed. It should be noted that the material need not be a full width belt but can be a strip of material such as that disclosed in U.S. Pat. No. 5,360,656 to Rexfelt, the disclosure of which is incorporated herein by reference, and subsequently formed into a full width belt. The strip can be unwound and wound up on a set of rolls after fully processing. These rolls of belting materials can be stored and can then be used to form an endless full width structure using, for example, the teachings of the immediately aforementioned patent.

Modifications to the above would be obvious to those of ordinary skill in the art, but would not bring the invention so modified beyond the scope of the appended claims. In particular, while piezojets are disclosed above as being used to deposit the material in preselected locations on the base substrate, other means for depositing droplets thereof in the size range desired may be known to those of ordinary skill in the art or may be developed in the future, and such other means may be used in the practice of the present invention. For example, in processes requiring a relatively larger scale pattern such that the final elements such as round hemispheres, a relatively large, even a single resin deposition nozzle can comprise the entire jet array. The use of such means would not bring the invention, if practiced therewith, beyond the scope of the appended claims. The use of such means would not bring the invention, if practiced therewith, beyond the scope of the appended claims.

What is claimed is:

1. A method for manufacturing resin impregnated endless belt structures, designed for use on a long nip press on a papermaking machine and for other papermaking and paper processing applications, said method comprising the steps of a) providing a base substrate for the belt;

b) depositing polymeric resin material onto said base substrate in a controlled manner so as to control the x, y, z dimensions of said material deposited to create a predetermined pattern of deposits, wherein each deposit comprises one or more droplets of material and wherein said predetermined pattern is to create the surface characteristic of said belt structures; and c) at least partially setting said polymeric resin material.

2. A method as claimed in claim 1 wherein said droplets have an average diameter of 10μ (10 microns) or more.

3. A method as claimed in claim 1 further comprising the optional step of abrading said polymeric resin material deposited on said base substrate to provide said polymeric resin material with a uniform thickness and a smooth, macroscopically monoplanar surface.

4. A method as claimed in claim 1 wherein steps b) and c) are performed sequentially on successive bands extending widthwise across said base substrate.

5. A method as claimed in claim 1 wherein steps b) and c) are performed sequentially on successive strips extending lengthwise around said base substrate.

6. A method as claimed in claim 1 wherein steps b) and c) are performed spirally around said base substrate.

7. A method as claimed in claim 1 wherein, in step b), said predetermined pattern comprises a plurality of discrete locations set forth in a predetermined array.

8. A method as claimed in claim 1 wherein, in step b), said predetermined pattern comprises a continuous network defining a plurality of discrete open areas in a predetermined array.

9. A method as claimed in claim 1 wherein, in step b), said predetermined pattern comprises a semicontinuous network extending substantially throughout said base substrate.

10. A method as claimed in claim 1 wherein, in step b), said predetermined pattern is visually smooth and uniform.

11. A method as claimed in claim 1 wherein, in step b), said polymeric resin material forms a layer of desired thickness over said base substrate in said predetermined pattern which may be random or uniform.

12. A method as claimed in claim 1 wherein, in step b), said polymeric resin material is deposited by a piezojet array comprising at least one individual computer-controlled piezojet.

13. A method as claimed in claim 1 further comprising, between steps b) and c), the steps of:

i) checking the actual pattern of said polymeric resin material to measure conformity to said predetermined pattern; and ii) repairing said actual pattern of said polymeric resin material to eliminate departures from said predetermined pattern.

14. A method as claimed in claim 13 wherein said checking step is performed by a fast pattern recognizer (FPR) processor operating in conjunction with a digital imaging camera.

15. A method as claimed in claim 14 wherein said repairing step is performed by a repair jet array coupled to said FPR processor.

16. A method as claimed in claim 1, wherein said polymeric resin material is selected from the group consisting of:

1. hot melts and moisture cured hot melts;
2. two part reactive systems based on urethanes and epoxies;
3. photopolymer compositions consisting of reactive acrylated monomers and acrylated oligomers derived from urethanes, polyesters, polyethers, and silicones; and
4. aqueous based latexes and dispersions and particle filled formulations including acrylics and polyurethanes.

17. A method as claimed in claim 1 wherein said setting step is performed by exposing said polymeric resin material to a heat source.

18. A method as claimed in claim 1 wherein said setting step is performed by exposing said polymeric resin material to cold air.

19. A method as claimed in claim 1 wherein said setting step is performed by exposing said polymeric resin material to actinic radiation.

20. A method as claimed in claim 11 wherein said piezojet array comprises a plurality of individual computer controlled piezojets, and wherein some of said individual computer controlled piezojets deposit one polymeric resin material while other individual computer controlled piezojets deposit another polymeric resin material.

21. A method as claimed in claim 20 wherein one polymeric resin material is hydrophilic and the other polymeric resin material is hydrophobic.

22. A method as claimed in claim 10 wherein said polymeric resin material is deposited in a uniformly thick layer having a monoplanar surface.

23. A method as claimed in claim 11 wherein said polymeric resin material is deposited in a non-uniformly thick layer having a surface with a three dimensional structure.

24. A method as claimed in claim 1 further comprising the step of depositing a polymeric resin material onto said base substrate in said predetermined pattern with a bulk jet to accelerate the manufacture of said belt.

25. A method as claimed in claim 24 wherein said depositing step is carried out prior to step b).

26. A method as claimed in claim 24 wherein said depositing step is carried out simultaneously with step b).

27. A method as claimed in claim 1 further comprising, between steps a) and b), the step of depositing a polymeric resin material onto said base substrate to coat the entire surface thereof and to render said base substrate impermeable.

28. A method as claimed in claim 27 wherein said polymeric resin material is deposited onto said base substrate by a bulk jet array.

29. A method as claimed in claim 28 wherein said polymeric resin material is deposited by a piezojet array comprising at least one individual computer controlled piezojet.

30. A method as claimed in claim 1 which includes the step of providing a base substrate taken from the group consisting essentially of woven, nonwoven, spiral formed, spiral-link, knitted, mesh or strips of material which are ultimately wound to form a belt having a width greater than a width of the strips.

31. A resin-impregnated endless belt structure, designed for use on a long nip press on a papermaking machine and for other papermaking and paper processing applications, said belt comprising a base substrate; and an x, y, z dimensionally controlled pattern of polymeric resin material deposits, said deposits comprising one or more droplets of polymeric resin material wherein said belt is made in a manner comprising the steps of:

a) providing a base substrate for the belt;

b) depositing polymeric resin material onto said base substrate in a controlled manner so as to control the x, y, z dimensions of said material deposited to create a predetermined pattern of deposits, wherein each deposit comprises one or more droplets of material and wherein said predetermined pattern is to create the surface characteristic of said belt; and c) at least partially setting said polymeric resin material.

32. A belt structure as claimed in claim 31 wherein said droplets have an average diameter of 10μ (10 microns) or more.

33. A belt structure as claimed in claim 31 further comprising the optional step of abrading said polymeric resin material deposited on said base substrate to provide said polymeric resin material with a uniform thickness and a smooth, macroscopically monoplanar surface.

34. A belt structure as claimed in claim 31 wherein steps b) and c) are preformed sequentially on successive bands extending widthwise across said base substrate.

35. A belt structure as claimed in claim 31 wherein steps b) and c) are performed sequentially on successive strips extending lengthwise around said base substrate.

36. A belt structure as claimed in claim 31 wherein steps b) and c) are performed spirally around said base substrate.

37. A belt structure as claimed in claim 31 wherein, in step b), said predetermined pattern comprises a plurality of discrete locations set forth in a predetermined array.

38. A belt structure as claimed in claim 31 wherein, in step b), said predetermined pattern comprises a continuous network defining a plurality of discrete open areas in a predetermined array.

39. A belt structure as claimed in claim 31 wherein, in step b), said predetermined pattern comprises a semicontinuous network extending substantially throughout said base substrate.

40. A belt structure as claimed in claim 31 wherein, in step b), said predetermined pattern is visually smooth and uniform.

41. A belt structure as claimed in claim 31 wherein, in step b), said polymeric resin material forms a layer of desired thickness over said base substrate in said predetermined pattern which may be random or uniform.

42. A belt structure as claimed in claim 31 wherein in step b), said polymeric resin material is deposited by a piezojet array comprising at least one individual computer-controlled piezojet.

43. A belt structure as claimed in claim 31 wherein said polymeric resin material is selected from the group consisting of:

1. hot melts and moisture-cured hot melts;

2. two-part reactive systems based on urethanes and epoxies;

3. photopolymer compositions consisting of reactive acrylated monomers and acrylated oligomers derived from urethanes, polyesters, polyethers, and silicones; and 4. aqueous-based latexes and dispersions and particle-filled formulations including acrylics and polyurethanes.

44. A belt structure as claimed in claim 43 wherein said polymeric resin material is deposited by a piezojet array comprising at least one individual computer-controlled piezojet.

45. A belt structure as claimed in claim 41 wherein said polymeric resin material is deposited in a uniformly thick layer having a monoplanar surface.

46. A belt structure as claimed in claim 41 wherein said polymeric resin material is deposited in a nonuniformly thick layer having a surface with a three-dimensional structure.

47. A belt structure as claimed in claim 31 further comprising the step of depositing a polymeric resin material onto said base substrate in said predetermined pattern with a bulk jet to accelerate the manufacture of said belt.

48. A belt structure as claimed in claim 47 wherein said depositing step is carried out prior to step b).

49. A belt structure as claimed in claim 47 wherein said depositing step is carried out simultaneously with step b).

50. A belt structure as claimed in claim 31 further comprising, between steps a) and b), the step of depositing a polymeric resin material onto said base substrate to coat the entire surface thereof and to render said base substrate impermeable.

51. A belt structure as claimed in claim 50 wherein said polymeric resin material is deposited onto said base substrate by a bulk-jet array.

52. A belt structure as claimed in claim 31 further comprising the step of providing a base substrate taken from the group consisting essentially of woven, nonwoven, spiral formed, spiral-link, knitted, mesh or strips of material which are ultimately spiral wound to form a belt having a width greater than a width of the strips.

53. A belt as in claim 38 wherein said network are parallel grooves.

54. A belt as in claim 38 wherein said network are crisscross grooves.

* * * * *